US008369767B2

(12) United States Patent
Izawa et al.

(10) Patent No.: US 8,369,767 B2
(45) Date of Patent: Feb. 5, 2013

(54) ELECTROPHOTOGRAPHIC PRINTER

(75) Inventors: Hideo Izawa, Narashino (JP); Takao Namiki, Narashino (JP); Junichi Setoyama, Narashino (JP); Kouichi Ooyama, Yokote (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 45 days.

(21) Appl. No.: 12/581,500

(22) Filed: Oct. 19, 2009

(65) Prior Publication Data

US 2010/0124431 A1 May 20, 2010

(30) Foreign Application Priority Data

Nov. 17, 2008 (JP) ..... 2008-292985

(51) Int. Cl.
*G03G 21/00* (2006.01)

(52) U.S. Cl. ..... 399/350; 399/101; 399/349

(58) Field of Classification Search ..... 399/101, 399/349, 350, 357
See application file for complete search history.

(56) References Cited

U.S. PATENT DOCUMENTS 3,759,220 A * 9/1973 Saito et al. ..... 118/261
4,890,135 A * 12/1989 Gardiner et al. ..... 399/348
6,347,212 B1 * 2/2002 Kosugi et al. ..... 399/348
7,991,343 B2 * 8/2011 Izawa et al. ..... 399/349
8,121,513 B2 * 2/2012 Izawa et al. ..... 399/101
2004/0234309 A1 * 11/2004 Nagata et al. ..... 399/348
2007/0223980 A1 * 9/2007 Fukumoto et al. ..... 399/348
2009/0208240 A1 * 8/2009 Saka ..... 399/101

FOREIGN PATENT DOCUMENTS

JP 2007-011142 * 1/2007
JP 2007-011142 A 1/2007

* cited by examiner

*Primary Examiner* — Walter L Lindsay, Jr.
*Assistant Examiner* — Benjamin Schmitt
(74) *Attorney, Agent, or Firm* — Westerman, Hattori, Daniels & Adrian, LLP

(57) ABSTRACT

An electrophotographic printer includes a transfer roller cleaning device 12 and a carrier liquid supply unit 11 disposed at a portion of the circumference of a transfer roller 2 between a position of image transfer onto a recording medium 7 and the transfer roller cleaning device and including a carrier liquid supply roll 13 in rotational contact with a surface of the transfer roller. The transfer roller cleaning device comprises a cleaning roll 17 rotating in rubbing contact with the surface of the transfer roller and having a bias voltage applied thereto which is of a polarity opposite to that of a residual toner; a peripheral surface scraping blade 18 positioned downstream of the cleaning roll in the rotation direction of the transfer roller; a side surface scraping blade 19 likewise positioned downward; and a surface scraping blade 26 disposed at a portion of the circumference of the cleaning roll.

4 Claims, 2 Drawing Sheets

ELECTROPHOTOGRAPHIC PRINTER

TECHNICAL FIELD

The present invention relates to an electrophotographic printer in which a toner image formed on a photoconductor drum from a liquid toner is primarily transferred onto a surface of a transfer roller and then the primary transfer image is secondarily transferred onto a recording medium (continuous paper) traveling sandwiched between the transfer roller and a backup roller to form a printed image thereon.

BACKGROUND ART

The surface of the transfer roller immediately after the secondary image transfer onto the recording medium becomes close to a dried solid upon absorption by the liquid medium of a carrier liquid of the liquid toner contained in the primary transfer image. Consequently, residual toner on the surface of the transfer roller is adhered thereto in a dried state.

While the residual toner on the surface of the transfer roller is generally removed by scraping with a cleaning blade, the problem arises that with the residual toner being in the dried state, the cleaning blade is poor in removal rate and must also be high in durability. The problem also arises that toner entering micropores in the surface of the transfer roller is hard to remove.

Accordingly, a conventional cleaning device of this type for a transfer roller includes: downstream of a region on the surface of the transfer roller for image transfer onto a recording medium, a wiping roller adapted to rotate reversely to the transfer roller for rubbing the transfer roller; and a pair of cleaning blades, the wiping roller and the cleaning blades being disposed in order from the upstream side in the rotation direction of the transfer roller. The wiping roller is rotated while being supplied with a cleaning liquid to rub off the residual toner on the transfer roller surface together with the cleaning liquid whereafter the two cleaning blades act to clean the transfer roller surface (see JP 2007-11142 A).

In the conventional transfer roller cleaning device mentioned above, the wiping roll while being supplied with the cleaning liquid, is designed to rub the transfer roller surface. That is, residual toner on the transfer roller surface has a cleaning liquid applied at a position of the wiping roller. Consequently, as the speed of rotation of the transfer roller is increased, cleaning of the residual toner with the cleaning liquid tends to fail. It has thus been difficult to meet with high-speed printing with continuous paper.

In view of what is mentioned above, it is an object of the present invention to provide an electrophotographic printer provided with a transfer roller cleaning device which has a capability of meeting with high-speed printing requirement with continuous paper used as its recording medium and of minimizing residual toner on a transfer roller surface in high-speed production as well.

DISCLOSURE OF THE INVENTION

In order to achieve the object mentioned above, there is provided in accordance with the present invention in a first aspect thereof an electrophotographic printer in which a toner image formed by a developing unit on a photoconductor drum is transferred via a transfer roller onto a recording medium and a surface of the transfer roller having the image transferred thereto is cleaned by a transfer roller cleaning device, characterized in that the printer comprises: a carrier liquid supply unit disposed at a portion of the circumference of the transfer roller between a position of the image transfer onto the recording medium and the transfer roller cleaning device and including a carrier liquid supply roll in rotational contact with the surface of the transfer roller for supplying a carrier liquid onto the surface of the transfer roller, and that the transfer roller cleaning device comprises: a cleaning roll rotating in rubbing contact with the surface of the transfer roller and having a bias voltage applied thereto which is of a polarity opposite to that of residual toner on the surface of the transfer roller; a peripheral surface scraping blade positioned downstream of the cleaning roll in the rotation direction of the transfer roller and in contact with a peripheral surface of the transfer roller; a side surface scraping blade likewise positioned downward and in contact with a side surface of the transfer roller; and a surface scraping blade disposed at a portion of the circumference of the cleaning roll and in contact with a surface of the cleaning roll.

And, in a second aspect of the present invention, the electrophotographic printer according to the first aspect of the invention includes single motors each of which controllably drives each of the carrier liquid supply roll of the carrier liquid supply unit and the cleaning roll of the transfer roller cleaning device, each of the single motors being individually controllable.

Also, in a third aspect of the present invention, the said transfer roller cleaning device included in the electrophotographic printer according to the first or second aspect of the invention includes urging mechanisms each of which urges each of the cleaning roll and the peripheral surface scraping blade of the transfer roller cleaning device, each of urging forces of the urging mechanisms towards the surfaces being adjustable.

Further, in a fourth aspect of the present invention, the electrophotographic printer according to the first aspect of the invention includes: a carrier liquid removing unit comprising a carrier liquid removing roll disposed at a portion of the circumference of the photoconductor drum and in rotational contact with a surface of the photoconductor drum, the carrier liquid removing roll having a bias voltage applied thereto which is of a polarity same as that of toner on the surface of the photoconductor drum, a peripheral surface scraping blade in contact with a peripheral surface of the carrier liquid removing roll, and a side surface scraping blade in contact with a side surface of the carrier liquid removing roll; a photoconductor drum cleaning device comprising a cleaning roll in rotational contact with the surface of the photoconductor drum for cleaning the surface of the photoconductor drum having the image transferred to the transfer roller, a peripheral surface scraping blade positioned downstream of the cleaning roll in the rotation direction of the photoconductor drum and in contact with the peripheral surface of the photoconductor drum, and a side surface scraping blade positioned likewise downstream and in contact with a side surface of the photoconductor drum; and urging mechanisms each of which urges each of the carrier liquid removing roll of the carrier liquid removing unit, the cleaning roll of the photoconductor drum cleaning device and the peripheral surface scraping blades, each of urging forces of the urging mechanisms towards the surfaces being adjustable.

Yet further, in a fifth aspect of the present invention, the cleaning roll of the said photoconductor cleaning device included in the electrophotographic printer according to the fourth aspect of the invention is brought into rubbing contact with the surface of the photoconductor drum and has a bias voltage applied thereto which is of a polarity opposite to that of residual toner on the surface of the photoconductor drum.

According to the present invention in the first aspect mentioned above, a carrier liquid can be supplied onto the surface of the transfer roller, upstream of the transfer roller cleaning device in the rotation direction of the transfer roller. Thus, the residual toner adhered in a dried state to the surface of the transfer roller can be softened by the carrier liquid before the transfer roller cleaning device functions to clean. A cleaning operation can, therefore, very well be performed by the transfer roller cleaning device even in high-speed printing with continuous paper used as its recording medium.

Also, the transfer roller cleaning device mentioned above is so designed that a cleaning roll is brought into rubbing contact with the surface of the transfer roller and has a bias voltage applied thereto which is of a polarity opposite to that of residual toner and the toner on peripheral and side surfaces of the transfer roller is scraped off by peripheral side surface scraping blades. Residual toner on the surface of the transfer roller can, therefore, be removed so as to minimize its amount even in high-speed production, and recording images can be maintained at a prescribed quality even in image printing onto a recording medium caused to travel at high speed.

Also, according to the second aspect of the invention mentioned above, single motors are used each of which is adapted to controllably drive each of the carrier liquid supply roll of the carrier liquid supply unit and the cleaning roll of the transfer roller cleaning device and is individually controllable. Proper rotations high in cleaning effect can, therefore, be selected as desired in the respective unit and device, thus making it possible to record images at high quality and at increased speed. Also, each of the rolls in following a change in image recording speed can be controlled at its optimum speed of rotation over an entire range of image recording speeds, thereby allowing production uniform in quality in an extended range of speed conditions while reducing the loss of paper.

Also, according to the third and fourth aspects of the invention mentioned above, the respective cleaning rolls of the transfer roller cleaning and photoconductor drum cleaning devices, the surface scraping blade in contact with the cleaning roll of the transfer roller cleaning device and the peripheral surface scraping blade of the photoconductor drum cleaning device in contact with the peripheral surface of the photoconductor drum can each be urged to come in contact with each of the surfaces mentioned above under an adjustable urging force, stabilizing each contact pressure and allowing images to be printed at a stabilized quality.

Also, according to the fourth aspect of the invention, the carrier liquid removing roll is designed to have a bias voltage applied thereto which is of a polarity same as that of toner on the surface of photoconductor drum. The carrier liquid removing roll can thus be rotated in contact with the photoconductor roll to remove an excessive carrier liquid on the surface of the photoconductor drum while causing the toner developed on the photoconductor drum to be pressed on the surface of the photoconductor drum. Also, according to the fifth aspect of the invention mentioned above, the cleaning roll of the photoconductor drum cleaning device is designed to have a bias voltage applied thereto which is of a polarity opposite to that of residual toner on the surface of the photoconductor drum, thus improving the cleaning effect by this cleaning roll.

BEST MODES FOR CARRYING OUT THE INVENTION

Figure 1:
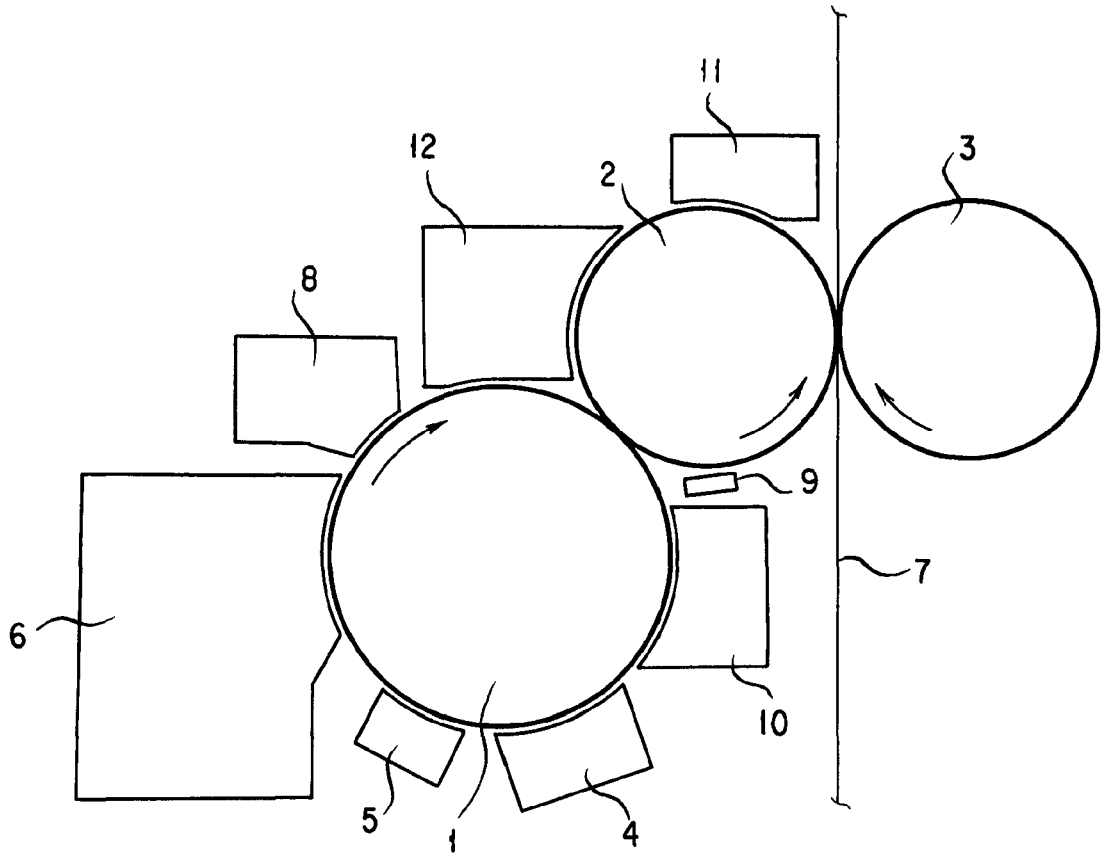
FIG. 1 is an explanatory view illustrating the makeup of an electrophotographic printer for carrying out the present invention.

FIG. 1 is an explanatory view which illustrates the makeup of an electrophotographic printer for carrying out the present invention. As shown, a photoconductor drum 1 is in rotational contact with a transfer drum 2 which in turn is in rotational contact with a backup roll 3.

In such an electrophotographic printer, the photoconductor drum 1 in image formation thereon is rotated by a drive means such as a motor (not shown) at a fixed speed in a direction of the arrow. The surface of the photoconductor drum 1 for image formation thereon is charged uniformly in the dark by a charging unit 4 and then has an electrostatic latent image formed thereon when an original light image is irradiated thereon and focused into by an exposure unit 5. Thereafter, the electrostatic latent image when passing through its processing region is visualized by a developing unit 6, forming a toner image on the surface of the photoconductor drum 1.

The toner image on the surface of the photoconductor drum 1 is primarily transferred onto a surface of the transfer roller 2 in a primary transfer region under a bias voltage applied via the transfer roller 2 and a nip pressure between the photoconductor drum 1 and the transfer roller 2. This primarily transferred toner image is secondarily transferred in a secondary transfer region on a recording medium 7 passing between the transfer drum 2 and the backup roller 3. The transfer roller 2 has its peripheral surface covered with an electrically conductive and elastomeric material.

And, provided also around the circumference of the photoconductor drum 1 are a carrier liquid removing unit 8, a charge eliminator 9 and a photoconductor drum cleaning device 10. The carrier liquid unit 8 is disposed downstream of the position of the developing unit 6 in the rotation direction of the photoconductor drum 1 for removing a portion (excessive amount) of a carrier liquid as the liquid toner image component after development. The charge eliminator 9 is disposed downstream of the area where the photoconductor drum 1 is in rotational contact with the transfer roller 2 for removing a residual potential staying behind on the photoconductor drum 1 after the primary image transfer onto the transfer roller 2. The photoconductor drum cleaning device 10 acts to remove a residual staying behind toner on the surface of the photoconductor drum 1.

Also, provided around the transfer roller 2 are a carrier liquid supply unit 11 and a transfer roller cleaning device 12. The carrier liquid supply unit 11 and the transfer roller cleaning device 12 are disposed downstream of the area where the transfer roller 2 is in rotational contact with the backup roller 3 in its rotation direction and between that area and the area where the transfer roller 2 is in rotational contact with the photoconductor drum 1 in order from its upstream side. The carrier liquid supply unit 11 acts to supply the carrier liquid onto the transfer roller 2 that is after the secondary image transfer, and the transfer roller cleaning device 12 serves to clean the surface of the transfer roller 2. And, this cleaning device 12 is disposed at a position spaced at a given distance from the carrier liquid supply unit 11, e.g., at a distance that is equal to ¼ of the peripheral length of the transfer roller 2.

Figure 2:
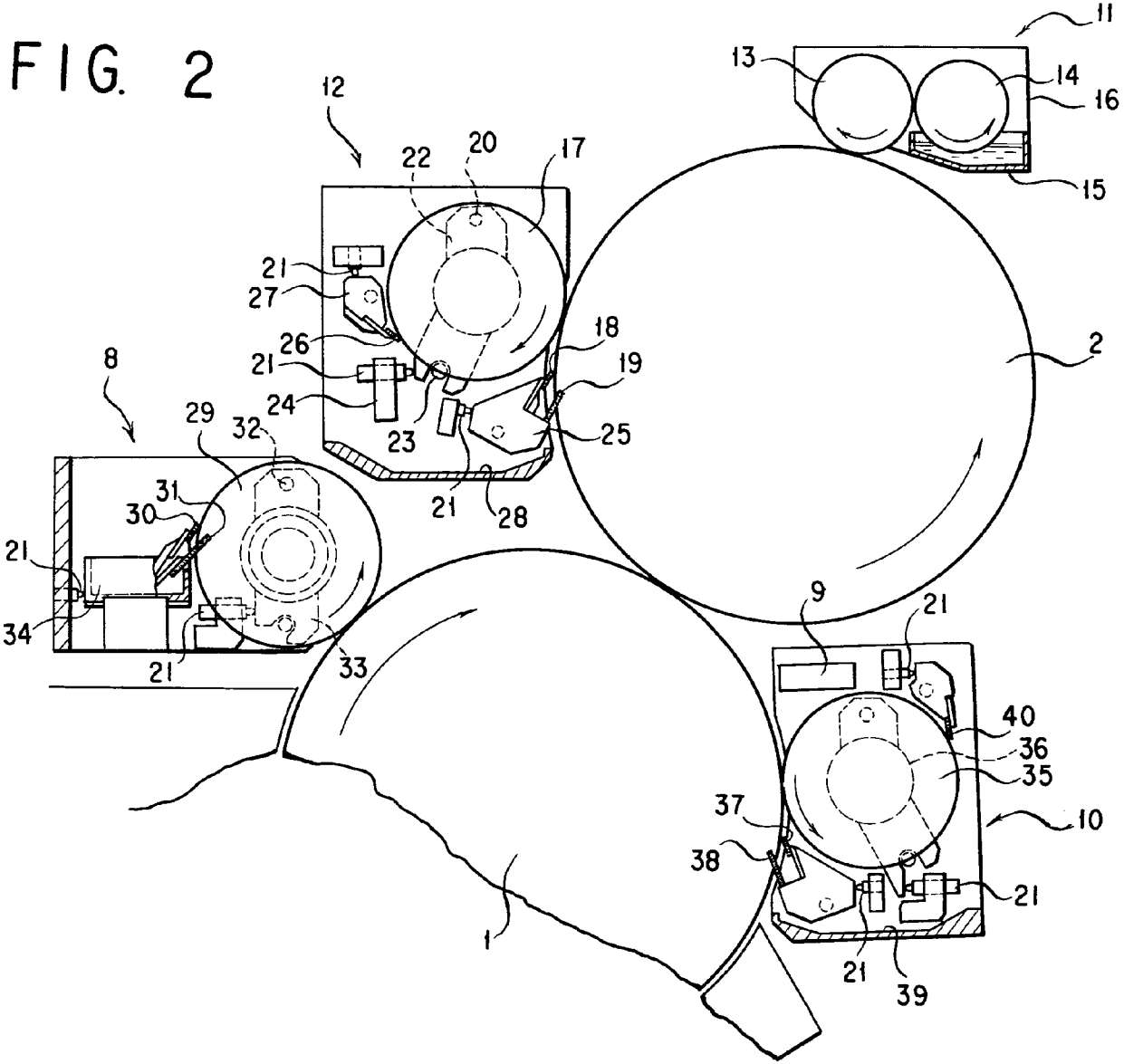
FIG. 2 is an explanatory view illustrating the makeup of an essential part of a form of implementation of the present invention.

Referring to FIG. 2, an explanation is next given of the makeup of each of the carrier liquid removing unit 8 and the photoconductor drum cleaning device 10 provided around the photoconductor drum 1 and the carrier liquid supply unit 11 and the transfer roller cleaning device 12 provided around the transfer roller 2.

First, mention is made of the carrier liquid supply unit 11 for supplying a carrier liquid onto the surface of the transfer roller 2 immediately after the secondary transfer is completed.

In the Figure there are shown a carrier liquid supply roll 13, a carrier liquid source roll 14, a carrier liquid trough 15 and a case 16 housing these.

The carrier liquid supply roll 13 is a roll whose surface is treated by plating with chromium and driven by a single motor so that the roll 13 is rotated in the normal direction with respect to the revolving peripheral surface of the rotating transfer roller 2 and in contact therewith and that the ratio of its surface velocity to that of the transfer roller 2 can be adjusted as desired. And, the carrier liquid supply unit 11 are supported by brackets (not shown) which are disposed at its both widthwise sides and which are driven by a pneumatic cylinder secured to the main frame so that the carrier liquid supply roll 13 can be moved towards and away from the transfer roller 2 and that the contact pressure between the carrier liquid supply roll 13 and the transfer roller 2 may be adjusted by adjusting a stopper provided to limit its movement towards the transfer roller 2 by the pneumatic cylinder.

The carrier liquid source roll 14 is coupled to the carrier liquid supply roll 13 via gears and driven by them. And, the carrier liquid source 14 is supported on an eccentric bearing whose axial center position can adjustably be moved to adjust its contact pressure with the carrier liquid supply roll 13. The carrier liquid source roll 14 has its lower part immersed in carrier liquid in the carrier liquid trough 15 stored with the carrier liquid and as it is rotated is designed to replenish carrier liquid on the carrier liquid supply roll 13. And its amount of replenishment can be adjusted by increase and decrease of the contact pressure.

The carrier liquid adjustably replenished in the form of a thin film from the carrier liquid source roll 14 is transferred via the carrier liquid supply roll 13 to, and received by, a surface of the transfer roller 2 as the latter is rotated in the normal direction with respect thereto. A residual toner becoming close to a dried state caused by absorption of the carrier liquid by the recording medium is supplied again with carrier liquid. This makes it easy to perform a cleaning operation by the transfer roller cleaning device 12 in a succeeding step with the residual toner.

Mention is next made of the makeup of the transfer roller cleaning device 12. The transfer roller cleaning device 12 comprises: a cleaning roll 17 rotating in the normal direction and in contact with the transfer roller 2; a peripheral surface scraping blade 18 orientated against the rotating transfer roller 2 and in contact with a peripheral surface of the transfer roller 2; and side surface scraping blades 19 oriented against the rotating transfer roller 2 and in contact with side surfaces (end surfaces perpendicular to the transfer surface that transfers the toner image to the recording medium) of the transfer roller 2, respectively.

The cleaning roll 17 is constituted by a metal roll having its surface plated. The cleaning roll 17 is supported on a rotary bracket 22 which is rotatable about its rotary fulcrum 20 towards and away from a surface of the transfer roller 2 and which is spring-biased by a spring plunger 21 towards a surface of the transfer roller 2. The rotary bracket 22 is formed at its lower end with a yoke with which a stopper pin 23 is engaged having a given spacing so that the rotary bracket 22 may be rotated or swung in this spacing. The rotary bracket 22 is mounted on a shaft of the cleaning roll 17 at each of its opposed axial ends.

The cleaning roll 17 is driven by a single motor and is designed to permit its surface speed with respect to the transfer roller 2 to be controllable by increase or decrease as desired. It is thus designed as a system with its speed settable at optimum to meet with printing conditions such as running speeds and images of an electrophotographic printer. The cleaning roll 17 also is given a cleaning function by electrophoresis generated by a bias voltage applied thereto which is of a polarity opposite to that of toner so as to attract the toner attached to a surface of the transfer roller 2. To wit, the electrophoretic action causes residual toner in micropores of a surface of the transfer roller 2 to float up and to be removed by attraction or adsorption.

The spring plunger 21 is supported by the bracket 24 by screw connection with the bracket 24. The spring plunger 21 has its tip member which in contact with the rotary bracket 22 is biased in the projecting direction by a spring received therein. And, rotating the spring plunger 21 through the bracket 24 to move the spring plunger 21 relative to the bracket 24 allows adjusting a force of urging the rotary bracket 22.

The peripheral surface scraping blade 18 and the side surface scraping blades 19 are supported by a rotary bracket 25. The rotary bracket 25 is biased and urged by a spring plunger 21 so that the peripheral surface scraping blade 18 may be urged to rotate towards a surface of the transfer roller 2.

Disposed at a portion of the circumference of a cleaning roll 17 is a peripheral surface scraping blade 26 for scraping the toner attached to a surface of the cleaning roll 17. The peripheral surface scraping blade 26 is supported by a rotary bracket 27 biased and urged by a spring plunger 21 towards a surface of the cleaning roll 17.

Under the both surface scraping blades 18 and 19 for the transfer roller 2 and the peripheral surface scraping blade 26 for the cleaning roll 17, a pan 28 is provided by which the toner scraped off by each of the blades 18, 19 and 26 is received for removal.

The carrier liquid removing unit 8 disposed at a portion of the circumference of the photoconductor drum 1 comprises a carrier liquid removing roll 29, a peripheral surface scraping blade 30 and side surface scraping blades 31. The carrier liquid removing roll 29 is in rotational contact with a surface of the photoconductor drum 1 to rotate in the normal direction. The peripheral surface scraping blade 30 is oriented against the rotation direction of the rotating carrier liquid removing roll 29 and is in contact with a peripheral surface of the carrier liquid removing roll 29. The side surface scraping blades 31 are oriented against the rotation direction of the rotating carrier liquid removing roll 29 and are in contact with the opposed side surfaces (end surfaces perpendicular to the bias voltage application surface to which a bias voltage is applied) of the carrier liquid removing roll 29, respectively. The carrier liquid removing roll 29 has its peripheral surface formed of electrically conductive rubber. The carrier liquid removing roll 29 has a bias voltage applied thereto which is of a polarity same as that of liquid toner to repel the same.

The carrier liquid removing roll 29 is supported on a rotary bracket 33 which is rotatable about its rotary fulcrum 32 towards and away from a surface of the photoconductor drum 1 and which is spring-biased by a spring plunger 21 towards a surface of the photoconductor drum 1. The rotary bracket 33 as is the case with the rotary bracket 22 for supporting the cleaning roll 17 in the transfer roller cleaning device 12 is designed to limit more than necessary degree of rotation with a stopper pin 23.

The peripheral and side surface scraping blades 30 and 31 are supported by a support table 34 which is movable towards and away from the surface of the carrier liquid removing roll 29. And, the support table 34 is biased and urged by a spring plunger 21 to move towards the roll 29. The support table 34 is made in the form of a pan which is designed to receive an excessive carrier liquid scraped off by the blades 30 and 31 for removal.

The photoconductor drum cleaning device 10 provided downstream of the charge eliminator 9 around the photoconductor drum 1 is constructed as is the case with the aforementioned transfer roller cleaning device 12. A cleaning roll 35 is supported by a rotary bracket 36 and is biased and urged by a spring in the spring plunger 21 towards the surface of the photoconductor drum 1. And, a peripheral surface scraping blade 37 oriented against the rotation direction of the rotating photoconductor drum 1 and in contact with a peripheral surface thereof and side surface scraping blades 38 oriented against the rotation direction of the rotating photoconductor drum 1 and in contact with side surfaces (end surfaces perpendicular to the image formation surface on which the toner image is formed) thereof, respectively, are supported by another rotary bracket and biased and urged by a spring in the spring plunger 21 towards the surfaces of the photoconductor drum 1. Also, a cleaning roll 35 in the photoconductor drum cleaning device 10 as is the case with the cleaning roll 17 in the transfer roller cleaning device 12 is driven by a single motor. Its peripheral speed is varied from that of the photoconductor drum 1 so that it is in rubbing contact with the photoconductor drum 1. Along with this, the cleaning roll 35 also is given a cleaning function by electrophoresis generated by a bias voltage applied thereto which is of a polarity opposite to that of toner so as to attract the toner attached or adhered to surface of the photoconductor drum 1. To wit, the electrophoretic action causes residual toner in micropores of a surface of the photoconductor drum 1 to float up and to be removed by attraction or adsorption. Under the photoconductor drum cleaning device 10 there is provided a pan 39 for receiving the toner scraped off by each of the blades. Around the cleaning device 35 as well, note that a peripheral surface scraping blade 40 is provided as biased by a spring plunger 21 to scrape off toner attached to the peripheral surface of the cleaning roll 35.

In the makeup mentioned above, in the carrier liquid supply unit 11 the carrier liquid supply roll 13 is driven by the single motor to rotate in the normal direction with respect to the transfer roller 2 and in contact with the transfer roller 2, thereby supplying the surface of the transfer roller 2 with the carrier liquid adjustably replenished in the form of a thin film from the carrier liquid source roller 14.

And, a residual toner image which becomes dried after a toner image is transferred to the recording medium 7 is softened by such supply of the carrier liquid, so that this achieves facilitating a cleaning operation by the transfer roller cleaning device 12 in the succeeding step.

Then, the rotary speed of the carrier liquid supply roll 13 can be varied as desired by controlling the single motor for driving the same and can thus be set at optimum with respect to the rotary speed of the transfer roller 2. Also, the contact pressure of the carrier liquid supply roll 13 onto the transfer roller 2 can be adjusted by moving the entire carrier liquid supply unit 11 with a pneumatic cylinder. Further, the rate of supply of the carrier liquid from the carrier liquid source roll 14 onto the carrier liquid supply roll 13 can be adjusted by varying the axial center position of the carrier liquid source roll 14 by adjusting the eccentric bearing supporting the roll 14 to adjust the contact pressure between the rolls 13 and 14.

The residual toner softened by supplying the carrier liquid from the carrier liquid supply unit 11 is cleaned by the transfer roller cleaning device 12.

In the transfer roller cleaning device 12, rotating the cleaning roll 17 at a peripheral speed slightly faster than that of the transfer roller 2 causes the surface of the cleaning roll 17 to rub or frictionally slide on the surface of the transfer roller 2, thus allowing the residual toner softened on the surface of the transfer roller to be attracted to the side of the cleaning roll 17 and removed thereby. Then, by controlling on the single motor driving the cleaning roll 17, the cleaning roll 17 can in speed be controlled by its increase and decrease as desired with respect to the transfer roller 2 and can have optimum speeds set therein to meet with various printing conditions such as running speed and image of the electrophotographic printer.

Also, the cleaning roll 17 will have electrophoresis generated by a bias voltage applied thereto which is of a polarity opposite to that of a toner so as to attract the toner. The electrophoretic action causes the residual toner in micropores of a surface of the transfer roller 2 to float up and to be removed by attraction. And, the toner attached to surface of the cleaning roller 17 is scraped off by the surface scraping blade 26.

Downstream of the transfer roller cleaning device 12 in the rotation direction of the transfer roller 2, the toner unremoved by the transfer roller cleaning device 12 and staying behind on a peripheral surface of the transfer 2 is scraped off by the peripheral surface scraping blade 18. Also, the toner that remains adhered on the side surfaces of the transfer roller 2 is scraped off by the side surface scraping blades 19.

The toner scraped off by each of the blades is received by the pan 28 for removal.

Also, in the transfer roller cleaning device 12, the force of urging the cleaning roll 17 to come in contact with the transfer roller 2, the force of urging the peripheral surface scraping blade 18 to come in contact with the transfer roller 2 and the force of urging the surface scraping blade 26 to come in contact with the cleaning roll 17 are obtained by the spring plungers 21 provided therefor, respectively, and are each adjusted by adjusting each spring plunger 21. Also, the cleaning roll 17 and the peripheral surface scraping blade 18 for the transfer roller 2 are biased by spring in the respective spring plungers 21 so that if there should be a run-out in the transfer roller 2, they follow the run-out by an elastic force of the spring plunger 21 and the urging force can be maintained always constant. And, each contact pressure on the transfer roller 2 can be subtly adjusted by an operation of each spring plunger 21. The same applies for the peripheral surface scraping blade 26 for the cleaning roll 17.

Mention is next made of operations of the carrier liquid removing unit 8 and the photoconductor drum cleaning device 10 provided around the photoconductor drum 1.

In the carrier liquid removing unit 8, the carrier liquid removing roll 29 rotationally in the normal direction in contact with the photoconductor drum 1 removes an excess of the carrier liquid from the photoconductor drum 1. And, after the removal a carrier liquid adhered on a peripheral surface of the carrier liquid removing roll 29 is scraped by the peripheral surface scraping blade 30 and a carrier liquid adhered on side surfaces of the carrier removing roll 29 by the side surface scraping blades 31, for reception by the support table 34 and removal.

Then, the carrier liquid removing roll 29 and the peripheral surface scraping blade 30 are spring biased against the photoconductor drum 1 and the carrier liquid removing roll 29 by the spring plungers 21 and 21, respectively.

Also, the carrier liquid removing roll 29 in the carrier liquid removing unit 8 has a bias voltage applied thereto which is a polarity same as that of toner, where the carrier liquid removing roll 29 in rotational contact with the photoconductor drum 1 causes a toner image developed on the photoconductor drum 1 to be pressed on the photoconductor side.

Around the rotating photoconductor drum 1, the photoconductor drum cleaning device 10 provided downstream of the charge eliminator 9 in the direction of this rotation is operated in a same manner as the transfer roller cleaning device 12 for the transfer roller 2, thereby cleaning the peripheral and side surfaces of the photoconductor drum 1.

What is claimed is:

1. An electrophotographic printer in which a toner image formed by a developing unit on a photoconductor drum is transferred via a transfer roller onto a recording medium and a surface of the transfer roller having the image transferred thereto is cleaned by a transfer roller cleaning device, characterized in that the printer comprises:

a carrier liquid supply unit disposed at a portion of the circumference of the transfer roller between a position of the image transfer onto the recording medium and said transfer roller cleaning device and including a carrier liquid supply roll rotating in the same direction with respect to and in rotational contact with the surface of the transfer roller for supplying a carrier liquid onto a surface of the transfer roller, and that said transfer roller cleaning device comprises:

a cleaning roll rotating in the same direction with respect to and in rubbing contact with the surface of the transfer roller and having a bias voltage applied thereto which is of a polarity opposite to that of residual toner on the surface of the transfer roller;

a peripheral surface scraping blade positioned downstream of said cleaning roll in the rotation direction of the transfer roller and in contact with a transfer surface of the transfer roller, the transfer surface being a peripheral curved surface of the transfer roller that transfers the toner image to the recording medium;

an end surface scraping blade likewise positioned downward and in contact with an end surface of the transfer roller, the end surface of the transfer roller being a flat surface perpendicular to the transfer surface that transfers the toner image to the recording medium;

a surface scraping blade disposed at a portion of the circumference of said cleaning roll and in contact with a surface of said cleaning roll; and urging mechanisms each of which has a spring plunger to urge each of the cleaning roll and the peripheral surface scraping blade of said transfer roller cleaning device, each of urging forces of said urging mechanisms being adjustable.

2. The electrophotographic printer as set forth in claim 1, further comprising single motors each of which controllably drives each of the carrier liquid supply roll of said carrier liquid supply unit and the cleaning roll of said transfer roller cleaning device, each of said single motors being individually controllable.

3. The electrophotographic printer as set forth in claim 1, further comprising:

a carrier liquid removing unit comprising a carrier liquid removing roll disposed at a portion of the circumference of the photoconductor drum and in rotational contact with a surface of the photoconductor drum, the carrier liquid removing roll having a bias voltage applied thereto which is of a polarity same as that of toner on the surface of the photoconductor drum, a peripheral surface scraping blade in contact with a peripheral surface of the carrier liquid removing roll, and an end surface scraping blade in contact with an end surface of the carrier liquid removing roll;

a photoconductor drum cleaning device comprising a cleaning roll in rotational contact with the surface of the photoconductor drum for cleaning the surface of the photoconductor drum having the image transferred to the transfer roller, a peripheral surface scraping blade positioned downstream of said cleaning roll in the rotation direction of the photoconductor drum and in contact with a peripheral surface of the photoconductor drum, and an end surface scraping blade positioned likewise downstream and in contact with an end surface of the photoconductor drum; and urging mechanisms each of which has a spring plunger to urge each of said carrier liquid removing roll of the carrier liquid removing unit, said cleaning roll of the photoconductor drum cleaning device and said peripheral surface scraping blades, each of urging forces of said urging mechanisms being adjustable.

4. The electrophotographic printer as set forth in claim 3, wherein the cleaning roll of said photoconductor cleaning device is brought into rubbing contact with the surface of said photoconductor drum and has a bias voltage applied thereto which is of a polarity opposite to that of residual toner on the surface of said photoconductor drum.

* * * * *